US012089739B2

(12) United States Patent
Sluiter et al.

(10) Patent No.: US 12,089,739 B2
(45) Date of Patent: Sep. 17, 2024

(54) RAIL AND BRACKET SYSTEM FOR A WALL-MOUNTED CABINET

(71) Applicant: The Stow Company, Holland, MI (US)

(72) Inventors: Cody Sluiter, Holland, MI (US); Peter Beebe, Holland, MI (US); Bryon Will, Holland, MI (US); Nathan Edwards, Hudsonville, MI (US)

(73) Assignee: The Stow Company, Holland, MI (US)

( * ) Notice: Subject to any disclaimer, the term of this patent is extended or adjusted under 35 U.S.C. 154(b) by 53 days.

(21) Appl. No.: 18/103,910

(22) Filed: Jan. 31, 2023

(65) Prior Publication Data

US 2024/0251946 A1 Aug. 1, 2024

(51) Int. Cl.
*A47B 96/06* (2006.01)

(52) U.S. Cl.
CPC ..... *A47B 96/06* (2013.01)

(58) Field of Classification Search
CPC ..... A47B 96/06
USPC ..... 248/125.1
See application file for complete search history.

(56) References Cited

U.S. PATENT DOCUMENTS 5,050,832 A * 9/1991 Lee ..... A47B 95/008 248/222.51
5,425,520 A * 6/1995 Masumoto ..... A47B 96/06 403/231
5,580,174 A * 12/1996 Houck ..... A47B 88/467 384/19
5,624,168 A * 4/1997 Licciardello, Sr. .. A47B 95/008 211/94.01
6,749,161 B1 * 6/2004 Will ..... B25H 3/04 248/222.51
7,083,056 B2 * 8/2006 Routhier ..... A47B 95/008 211/90.04
7,428,972 B2 * 9/2008 Warner ..... A47F 5/0823 211/94.01
8,061,539 B2 * 11/2011 Punzel ..... A47B 47/021 248/220.21
10,021,973 B1 * 7/2018 Will ..... A47B 47/042
12,000,419 B1 * 6/2024 Bollman ..... E04C 3/04
2011/0309731 A1 * 12/2011 Lindvall ..... A47B 95/008 312/352

(Continued)

FOREIGN PATENT DOCUMENTS

EP 2 615 942 B1 8/2017
EP 2 412 275 B1 9/2019

*Primary Examiner* — Muhammad Ijaz
(74) *Attorney, Agent, or Firm* — Varnum LLP

(57) ABSTRACT

A rail and bracket system for mounting a floating structure or series of floating structures, such as one or more cabinets, to a vertical substrate is provided. The rail and bracket system comprises a rail component and a pair of end support brackets configured to slidably engage with the rail component. The rail and bracket system provides easy alignment and installation of floating structure(s) onto a vertical substrate with no legs or back panel required for such installation, utilizes tandem weight distribution to support and secure the respective floating structure(s) to the vertical substrate, and is configured to support one or more floating structures with sufficient depth (up to about 30 inches) while providing installed stability to the respective floating structure(s) to avoid deformation at heavy loads in excess of 250 pounds.

19 Claims, 6 Drawing Sheets

(56) References Cited

U.S. PATENT DOCUMENTS

| | | | | |
|---|---|---|---|---|
| 2012/0062083 | A1* | 3/2012 | Lewis, II | H05K 7/183<br>248/231.61 |
| 2013/0134849 | A1* | 5/2013 | Menzel | A47B 95/008<br>312/265.5 |
| 2016/0045026 | A1* | 2/2016 | Trunkle | A47B 95/008<br>248/241 |
| 2018/0245617 | A1* | 8/2018 | Hughes | G01B 3/1056 |
| 2019/0290001 | A1* | 9/2019 | King | A47B 95/008 |
| 2022/0120492 | A1* | 4/2022 | Bickel | F25D 23/067 |
| 2022/0151385 | A1* | 5/2022 | Graber | A47B 96/067 |

* cited by examiner

RAIL AND BRACKET SYSTEM FOR A WALL-MOUNTED CABINET

TECHNICAL FIELD

The present disclosure generally relates to a mounting system for a floating structure, and more particularly a rail and bracket system for use in mounting a floating structure to a vertical substrate such as, but not limited to, wall-mounted cabinets.

BACKGROUND

Various mounting systems are known in the art for installation of storage fixtures such as cabinets, shelves, drawers, or the like onto vertical substrates, e.g., walls. Common systems employ the use of multiple component parts, for example symmetrical mounting hardware that is adapted for use on opposing sides of the cabinet for attachment of the cabinet to the vertical substrate or wall. In such instances, each component part requires a separate mount by the installer. Whereafter, careful alignment, positioning, and/or measuring of the component parts relative to each other becomes necessary to ensure that the cabinet is level and properly installed. In such applications, installation is usually difficult, time intensive, and may require more than one individual during the mounting and aligning of the cabinet to the vertical substrate or wall.

Other common systems in the art require the use of support legs extending from the cabinet for attachment to the wall or installation of additional mounting structures or heavy and sizable back panels, each utilizing valuable useable space within the cabinet or on the wall and increasing the difficulty and time required to install the system.

As such, there is a need for a rail and bracket system that utilizes a reduced number of component parts and offers effective and efficient alignment and installation of floating storage fixtures such as cabinets, shelves, drawers, or the like onto vertical substrates, such as walls, without the use of support legs or back panels.

BRIEF SUMMARY OF THE INVENTION

The present disclosure is directed to a rail and bracket system for a wall-mounted structure, such as a cabinet. According to one embodiment of the invention, the rail and bracket system may comprise a rail component and a pair of end support brackets.

The rail component comprises a first extension element defining a first surface and a second extension element defining a second surface. Each of the first extension element and the second extension element extend from a first end of the rail component to a second end of the rail component. The second surface defined by the second extension element is adapted to be mounted to and disposed in contact with a vertical substrate, such as a wall or the like and the first surface defined by the first extension element is adapted to be mounted to and disposed in contact with an interior surface of a floating structure, more specifically the interior surface of the top horizontal panel of a cabinet.

The pair of end support brackets are configured to slidably engage with the rail component, such that the first end support bracket slidably engages with the first end of the rail component and the second end support bracket slidably engages with the second end of the rail component. The end support brackets are further configured to be coupled with the respective vertical side panels of the respective floating structure or cabinet.

The present disclosure further provides a method of mounting a floating structure, such as a cabinet, to a vertical substrate or wall via the rail and bracket system of the present disclosure. The method may comprise the following steps: providing a rail and bracket system comprising a rail component and a pair of end support brackets; positioning the second surface defined by the second extension element in contact with the vertical substrate, such that the rail component is disposed in a horizontally-leveled position on the vertical substrate; securing the rail component to the vertical substrate; slidably engaging the pair of end support brackets onto the respective first end and second end of the rail; placing the floating structure upon the rail component, such that the first surface of the first extension element is disposed in contact with an interior surface of a top horizontal panel of the floating structure; completing an initial securement of the floating structure to the rail component by coupling the first extension element of the rail component and the top horizontal panel of the floating structure by inserting a security feature through a security mounting aperture defined by the first extension element of the rail component and into the top horizontal panel of the floating structure; aligning and leveling the top horizontal panel of the floating structure; completing a final securement of the floating structure to the rail component; securing each of the end support brackets to a respective pair of opposing vertical side panels of the floating structure; and securing the end support brackets to the rail component.

BRIEF DESCRIPTION OF THE DRAWINGS

The embodiments set forth in the drawings are illustrative and exemplary in nature and not intended to limit the subject matter. The following detailed description of the illustrative embodiments can be understood when read in conjunction with the following drawings, where like structure is indicated with like reference numerals and in which.

DETAILED DESCRIPTION OF THE INVENTION

Figure 1:
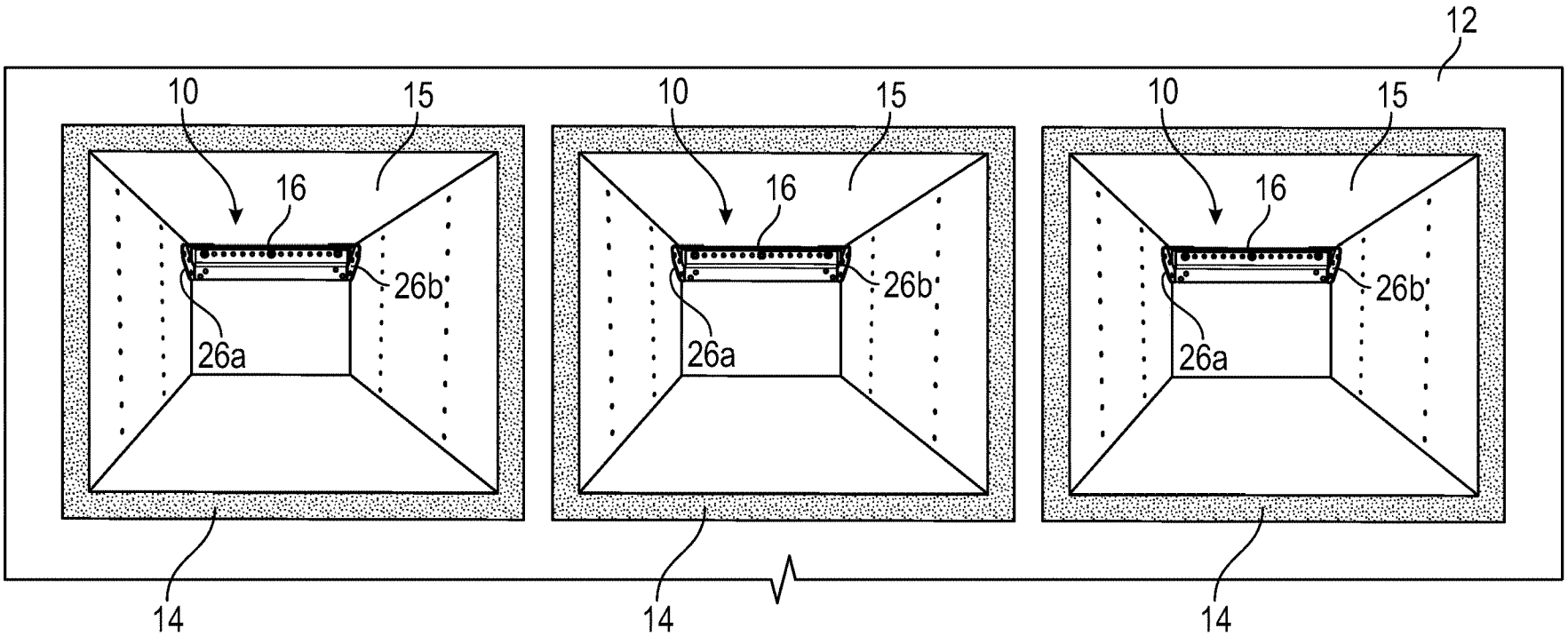
FIG. 1 is a perspective view of three illustrative rail and bracket systems employed on a grouping of three cabinets, presented in a linear series orientation, in accordance with the present disclosure.
Figure 2:
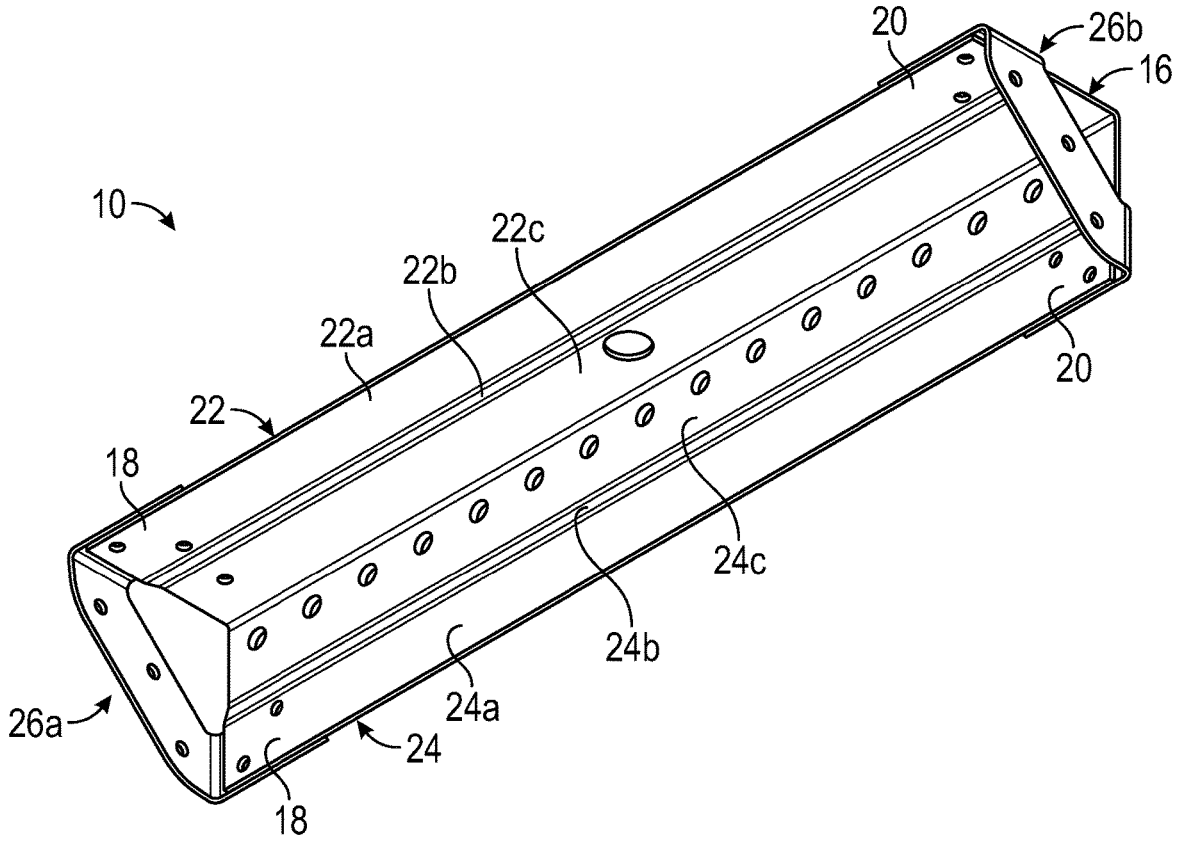
FIG. 2 is a perspective view of the rail and bracket system.
Figure 3:
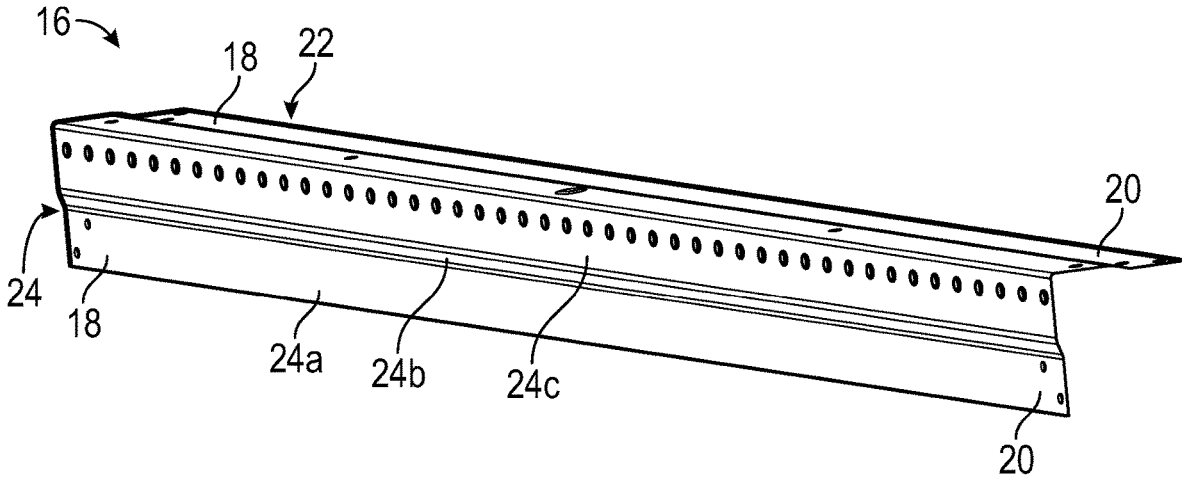
FIG. 3 is a perspective view of an illustrative rail component.
Figure 4:
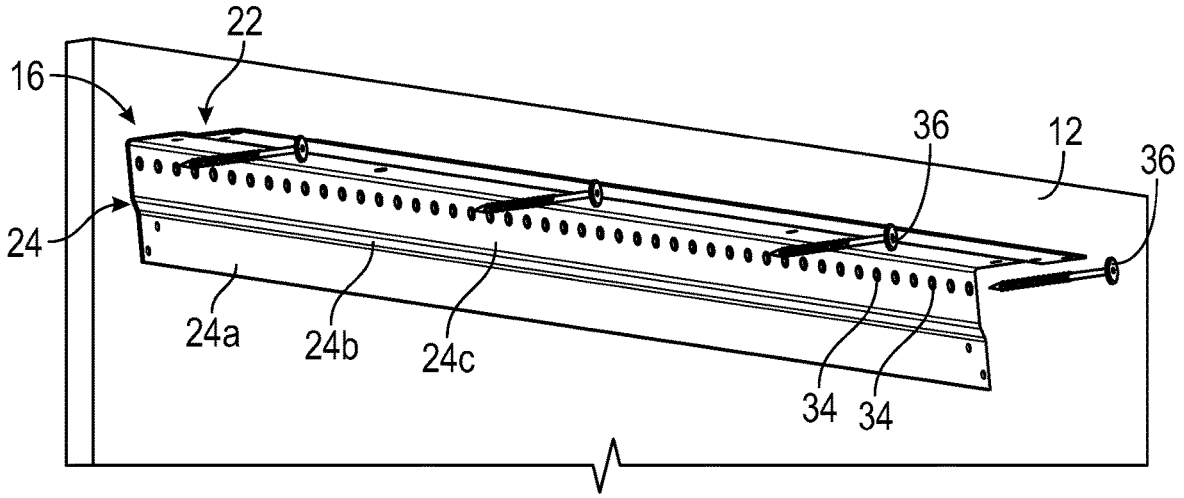
FIG. 4 is a second perspective view of the illustrative rail component adapted for fastening to a vertical substrate with attachment features.

While the present disclosure may be described with respect to specific applications or industries, those skilled in the art will recognize the broader applicability of the disclosure.

Those having ordinary skill in the art will recognize the terms such as "a", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

For consistency and convenience, directional adjectives are employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims. Any numerical designations, such as "first" or "second" are illustrative only and are not intended to limit the scope of the disclosure in any way.

The following discussion and accompanying figures disclose a rail and bracket system. While the rail and bracket system is illustrated and described herein for use in wall-mounted cabinet hanging applications, it will be understood that the rail and bracket system may be used for a variety of storage fixtures such as, but not limited to, cabinets, vanities, shelves, drawers, or the like, and in any desired location including, but not limited to, garages, bathrooms, kitchens, rooms within residential and/or business settings, or the like. It is contemplated that the rail and bracket system may be employed for the alignment and hanging of a singular cabinet or a series of cabinets (e.g., two or more cabinets) in a linear or vertical orientation. Furthermore, while the rail and bracket system is illustrated as secured to a wall, it will be understood that the rail and bracket system may be secured to any desired substantially vertical substrate wherein flush mounting can be achieved in a manner similar to that described herein.

In a general sense, the rail and bracket system 10 of the present disclosure is designed for effective and efficient alignment and installation of a floating structure 14 or series of floating structures, e.g., one or more cabinets onto a wall 12 or other vertical substrate, with no legs or back panel required for such installation. More particularly, the rail and bracket system 10 of the present disclosure utilizes tandem weight distribution to support and secure the respective floating structure(s) to the vertical substrate, i.e., the rail attaches to the interior surface 15 of the top panel 14*a* of the floating structure(s) 14 and the end support brackets 26*a*, 26*b* attach to the respective vertical side panels 14*b* of the floating structure(s) 14. Additionally, the rail and bracket system 10 of the present disclosure is configured to support a singular floating structure or cabinet 14 with sufficient depth (up to about 30 inches). Multiple rail and bracket systems 10 may support multiple floating structures or cabinets 14 aligned in series with sufficient depth (up to about 30 inches). The rail and bracket system 10, when installed in as a single unit or in series, is envisioned to provide an installed stability to the respective floating structure(s) or cabinet(s) 14 to avoid deformation at heavy loads in excess of 250 pounds.

More particularly, referring now to the drawings, wherein like reference numerals refer to like components throughout the several views, FIG. 1 shows a series of three (3) rail and bracket systems 10 in one exemplary embodiment, wherein the respective rail and bracket systems 10 secure a floating structure 14, such as a cabinet to a vertical substrate 12, namely a wall. The rail and bracket system 10 in such an example embodiment is configured to support a cabinet 14 (three separate cabinet units shown), intended for flush mounting to the wall 12 without the need for additional support legs or a mounting back panel. Furthermore, the rail and bracket system 10 utilizes tandem weight distribution to support and secure the cabinet 14 to the wall 12, e.g., the rail attaches to the interior surface of the top horizontal panel of the cabinet and the end support brackets attach to the vertical panels of the cabinet. As shown in FIG. 1, each respective cabinet 14 is supported by one rail and bracket system 10. The number of cabinets 14 may be arranged in a series of greater or lesser quantities as desired by the installer. Each rail and bracket system 10 may include at least a rail component 16 and a pair of end support brackets 26*a*, 26*b*.

The rail component 16 and a pair of end support brackets 26*a*, 26*b* of the rail and bracket system 10 may be formed of metallic materials, polymeric materials, or any other suitable materials or combinations thereof. For example, the metallic material may be selected from an aluminum-based material, a steel-based material, an alloy, or any combination thereof or the like. The polymeric material may be selected from a thermoset polymer, a thermoplastic polymer, a polymer-based composite material, a plastic, or any combination thereof or the like. It is contemplated that the rail component 16 and pair of end support brackets 26*a*, 26*b* may be formed of the same material, although different materials may be utilized. The rail component 16 and end support brackets 26*a*, 26*b* may be powder coated, plated, painted, stained, or otherwise finished and/or treated using common methods known to individuals skilled in the relevant art. In one example, the rail component 16 and pair of end support brackets 26*a*, 26*b* are constructed of powder-coated steel.

Furthermore, the rail component 16 and pair of end support brackets 26*a*, 26*b* may be formed by injection molding, extrusion, die casting, stamping, machining, or otherwise manufactured using common methods known to individuals skilled in the relevant art. The above examples are not intended to be limiting in any matter, as it will be understood that the materials and/or methods used to form the rail component 16 and/or end support brackets 26*a*, 26*b* may vary based on the intended use of the rail and bracket system 10, the location of installation, as well as the overall dimensions of the rail and bracket system 10.

Figure 5:
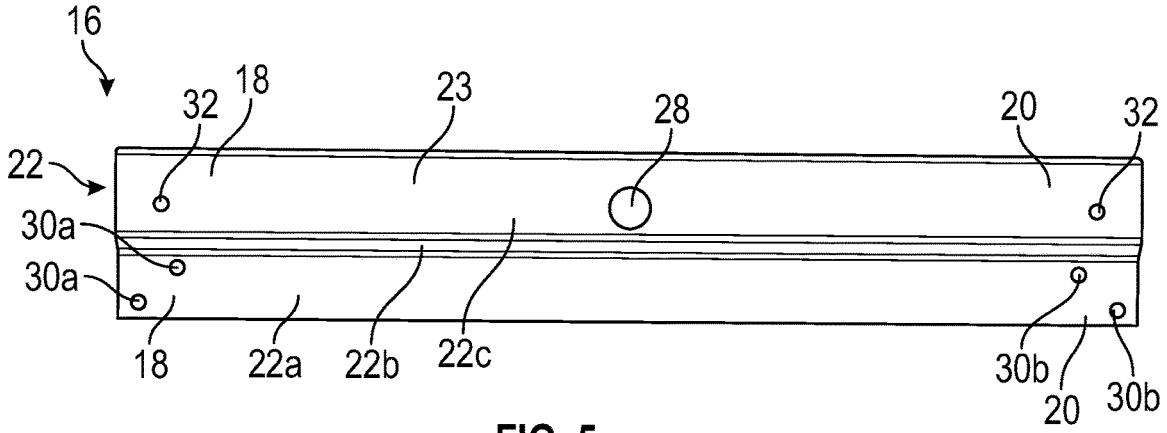
FIG. 5 is a plan view of the illustrative rail component.
Figure 6:
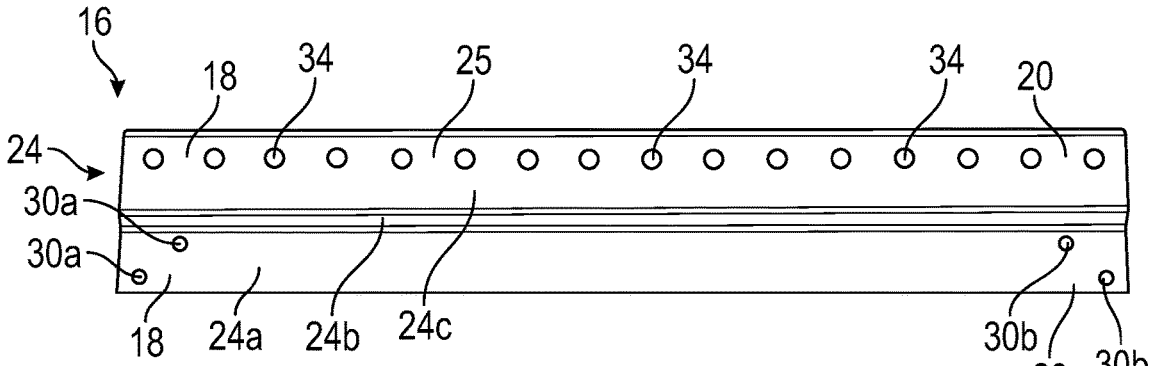
FIG. 6 is a rear view of the illustrative rail component.

Referring now to FIGS. 2-3 and 5-7 generally, the rail component 16 of the rail and bracket system 10 comprises opposing ends, a first end 18 and second end 20, a first extension element 22, and a second extension element 24. Each of the first extension element 22 and the second extension element 24 extend from the first end 18 of the rail component 16 to the second end 20 of the rail component 16. In one example, the first extension element 22 and the second extension element 24 may meet at an angled abutment, such that the rail component is formed as a substantially L-shaped elongated rail. The first extension element 22 defines a first surface 23 that is adapted to be mounted to and disposed in contact with an interior surface of a floating structure, more specifically the interior surface 15 of the top horizontal panel 14*a* of a cabinet 14 (FIG. 1 and FIG. 5). The second extension element 24 defines a second surface 25 and is adapted to be mounted to and disposed in contact with the vertical substrate, such as a wall 12 (FIG. 1 and FIG. 6). The rail component 16 may have a length from about 18 inches to about 48 inches. However, other lengths are equally possible based on the intended use of the rail and bracket system 10, in order to achieve the desired result of the installer, in view of the present teachings.

Figure 7:
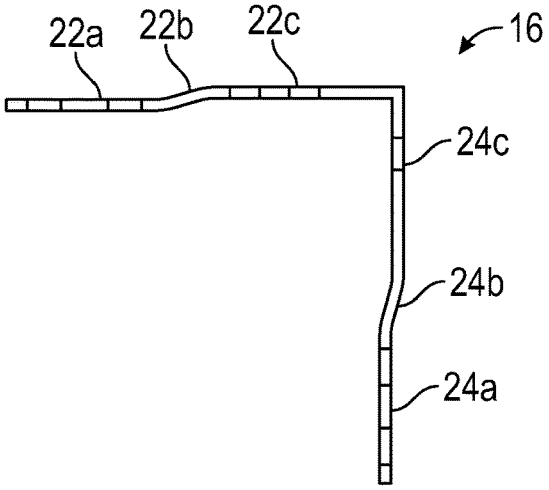
FIG. 7 is a side view of the illustrative rail component.

Referring in particular to FIGS. 5 and 7, the first extension element 22 of the rail component 16 defines a first surface 23 and is adapted to be mounted to and disposed in contact with an interior surface of a floating structure 14, more specifically the interior surface 15 of the top horizontal panel 14*a* of a cabinet 14. The first extension element 22 of the rail component 16 has a first portion 22*a*, a second portion 22*b*, and a third portion 22*c*. Each of the first, second, and third portions 22*a-c* extend from the first end 18 to the second end 20 of the rail component 16. The first portion 22*a* of the first extension element 22 is radially spaced apart from and substantially parallel with the third portion 22*c* of the first extension element 22. The second portion 22*b* of the first extension element 22 extends from the first portion 22*a* of the first extension element 22 to the third portion 22*c* of the first extension element 22, such that the second portion 22*b* is transverse or angled with respect to each of the first portion 22*a* of the first extension element 22 and the third portion 22*c* of the first extension element 22. Furthermore, when the rail and bracket system 10 is secured to the vertical substrate or wall 12, the first, second, and third portions 22*a-c* protrude in an outward direction, extending therefrom.

Referring again to FIGS. 5 and 7, the first portion 22*a* of the first extension element 22 of the rail component 16 may include a plurality of apertures 30*a* (the fourth plurality of apertures). The plurality of apertures 30*a* may be located at the first end 18 of the first portion 22*a* of the rail component 16 and are utilized for attachment of the rail component 16 to the first end support bracket 26*a*. The plurality of apertures 30*a* may be spatially arranged along the first end 18 of the rail component 16. The first portion 22*a* of the first extension element 22 of the rail component 16 may also include a plurality of apertures 30*b* (the fifth plurality of apertures). The plurality of apertures 30*b* may be located at the second end 20 of the first portion 22*a* of the rail component 16 and are utilized for attachment of the rail component 16 to the second end support bracket 26*b*. The plurality of apertures may be spatially arranged along the second end 20 of the rail component 16. The first portion 22*a* does not substantially contact the interior 15 of the top horizontal panel 14*a* of the cabinet 14 when the cabinet 14 is supported on the rail component 16.

Turning now to the second portion 22*b* as illustrated in FIGS. 5 and 7, the first portion 22*a* of the first extension element 22 is radially spaced apart from and substantially parallel with the third portion 22*c* of the first extension element 22 and the second portion 22*b* of the first extension element 22 extends from the first portion 22*a* to the third portion 22*c*. As such, the second portion 22*b* is transverse to each of the first portion 22*a* and the third portion 22*c*. Said another way, the second portion 22*b* may be angled or recessed between the first portion 22*a* and the third portion 22*c* thereof. Due to the relative angle or recess, the second portion 22*b* does not substantially contact the interior 15 of the top horizontal panel 14*a* of the cabinet 14 when the cabinet 14 is supported on the rail component 16. The second portion 22*b* also aids in the placement of the pair of end support brackets 26*a*, 26*b* onto the rail component 16.

Referring still to FIGS. 5 and 7, the third portion 22*c* defines the first surface 23. As such, the third portion 22*c* of the first extension element 22 of the rail component 16 is generally flat and adapted such that the first surface 23 defined thereby is configured to be placed in contact with the top horizontal panel 14*a* of the cabinet 14 when the cabinet 14 is supported on the rail component 16.

The third portion 22*c* may further define a security mounting aperture 28. The security mounting aperture 28 aids in the attachment of the rail component 16 to the interior of the floating structure or cabinet 14, specifically the interior surface 15 of top horizontal panel 14*a*, via use of a security fastener 38. The security mounting aperture 28 and corresponding fastener 38 allow for the initial securement of the cabinet 14 upon the rail component 16 so as to confirm proper and desired positioning by the installer before having to fasten the pair of end support brackets 26*a*, 26*b* to the rail component 16 and cabinet 14. Said another way, the insertion of the security mounting aperture 28 through the security fastener 38 initially helps to keep the cabinet 14 on the rail component 16 so the installer can align and level the cabinet 14 prior to the installation and securement of the end support brackets 26*a*, 26*b* to the cabinet 14. The security mounting aperture 28 may be positioned substantially at or near the midpoint of the first and second ends 18, 20 of rail component 16.

The third portion 22*c* of the first extension element 22 of the rail component 16 may further include a plurality of apertures 32 (the second plurality of apertures). The plurality of apertures 32 may be configured to receive a plurality of fastening features 40 (FIG. 10B), such that the plurality of fastening features 40 is configured to secure the floating structure, specifically the interior 15 of the top horizontal panel 14*a* of the cabinet 14 to the rail component 16. The plurality of apertures 32 may be disposed along the length of the third portion 22*c* of the rail component 16 between the first end 18 and the second end 20. Alternatively, the plurality of apertures 32 may be positioned at the opposing ends 18, 20 of the third portion 22*c* of the rail component 16. In one example embodiment, the plurality of apertures 32 may be located in positions of equal distance in between the opposing ends 18, 20 of the third portion 22*c*. The number of apertures and placement may vary depending on the overall length of the rail component 16; for example, longer rails may require more apertures 32 placed at locations spaced along the length of the rail component 16 to aid in attachment of the cabinet 14 to the rail component 16.

Referring in particular to FIGS. 6 and 7, the second extension element 24 of the rail component 16 defines a second surface 25 and is adapted to be mounted to and disposed in contact with a vertical substrate, such as a wall 12. The second surface 24 has a first portion 24*a*, a second portion 24*b*, and a third portion 24*c*. Each of the first, second, and third portions 24*a-c* extend from the first end 18 to the second end 20 of the rail component 16. The first portion 24*a* of the second extension element 24 is radially spaced apart from and substantially parallel with the third portion 24*c* of the second extension element 24. The second portion 24*b* of the second extension element 24 extends from the first portion 24*a* of the second extension element 24 to the third portion 24*c* of the second extension element 24, such that the second portion 24*b* is transverse to each of the first portion 24*a* of the second extension element 24 and the third portion 24*c* of the second extension element 24. Said another way, the second portion 24*b* may be angled or recessed between the first portion 24*a* and the third portion 24*c* thereof. While the first, second, and third portions 24*a-c* each face the wall 12 when the rail and bracket system 10 is secured to the wall 12, due to the relative angle or recess of the second portion 24*b*, each of the first portion 24*a* and second portion 24*b* do not substantially contact the vertical substrate or wall 12, when rail component 16 is secured thereto. Rather the second surface 25 of the third portion 24*c* is disposed in contact with the vertical substrate or wall 12, when rail component 16 is secured thereto. The second portion 24*b* aids in the placement of the pair of end support brackets 26*a*, 26*b* onto the rail component 16.

As shown in FIG. 6, the first portion 24*a* of the second extension element 24 of the rail component 16 may include a plurality of apertures 30*a* (the fourth plurality of apertures). The plurality of apertures 30*a* may be located at the first end 18 of the first portion 24*a* of the rail component 16 and are utilized for attachment of the rail component 16 to the first end support bracket 26*a*. The plurality of apertures 30*a* may be spatially arranged along the first end 18 of the rail component 16. The first portion 24*a* of the second extension element 24 of the rail component 16 may also include a plurality of apertures 30*b* (the fifth plurality of apertures shown at FIGS. 6 and 10B). The plurality of apertures 30*b* may be located at the second end 20 of the first portion 24*a* of the rail component 16 and are utilized for attachment of the rail component 16 to the second end support bracket 26*b*. The plurality of apertures may be spatially arranged along the second end 20 of the rail component 16.

Referring once more to FIG. 6, the third portion 24*c* of the second extension element 24 of the rail component 16 is generally flat and adapted such that the second surface 25 is placed flush against and in contact with the wall 12 when the rail component 16 is secured thereto. The third portion 24*c* may include a plurality of apertures 34 (the first plurality of apertures) for use in attachment of the rail component 16 to the wall 12. The plurality of apertures 34 may be disposed along the length of the rail component 16 from the first end 18 to the second end 20. In one example embodiment, the plurality of apertures 34 are located in positions of equal distance from the first end 18 to the second end 20 of the second extension element 24.

Figure 8:
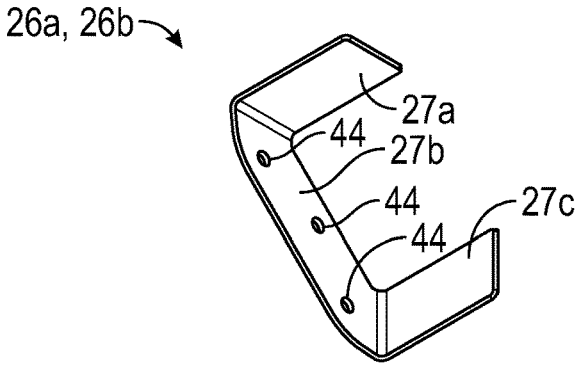
FIG. 8 is a perspective view of an illustrative end support bracket.
Figure 9:
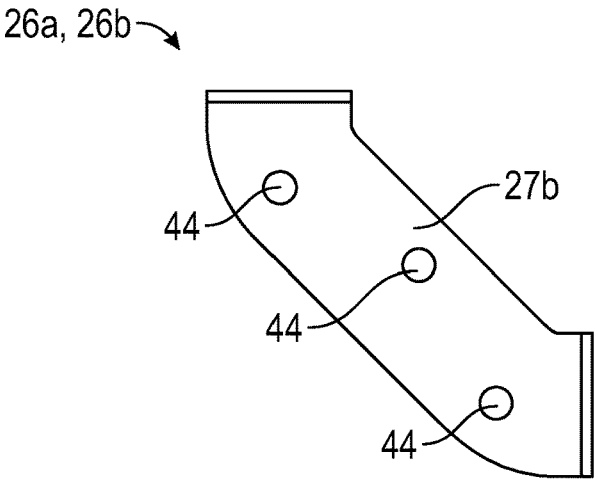
FIG. 9 is a side view of the illustrative end support bracket.

Referring now to FIGS. 8 and 9, an example end support bracket 26*a*, 26*b* of the rail and bracket system 10 is shown. The first and second end support brackets 26*a*, 26*b* are configured to slidably engage onto and along the opposing ends 18, 20 of the rail component 16. The end support brackets 26*a*, 26*b* may have a first flange 27*a*, a second flange 27*c*, and an intermediate portion 27*b* that extends from the first flange 27*a* to the second flange 27*c*. The end support brackets 26*a*, 26*b* may further include a plurality of apertures 44 (the third plurality of apertures) spatially arranged along the intermediate portion 27*b*. Each of the plurality of apertures 44 may be configured to receive a securing feature 46 (FIG. 10C), such that the respective securing features 46 secure each of the first end support bracket 26*a* and the second end support bracket 26*b* to the interior surface 15 of a floating structure 14.

Next, an exemplary method of mounting a floating structure, such as a cabinet 14, to a vertical substrate, such as a wall 12, via the rail and bracket system 10 of the present disclosure is described and illustrated in FIGS. 1, 4, 10A-C, and 11. While attachment features 36, coupling features 42, securing features 46, fastening features 40, and the security faster 38 may be depicted as screws, it will be appreciated that other suitable means may be utilized as necessary to achieve the desired result of the installer within view of the present teachings. Furthermore, it is contemplated that the suitable fastener means may be formed of any suitable material including, but not limited to, a metallic material. Lastly, it is contemplated that the corresponding apertures 28, 30*a*, 30*b*, 32, 34, 44 may be threaded or otherwise adapted to receive the corresponding fastener in a secure manner.

Figure 11:
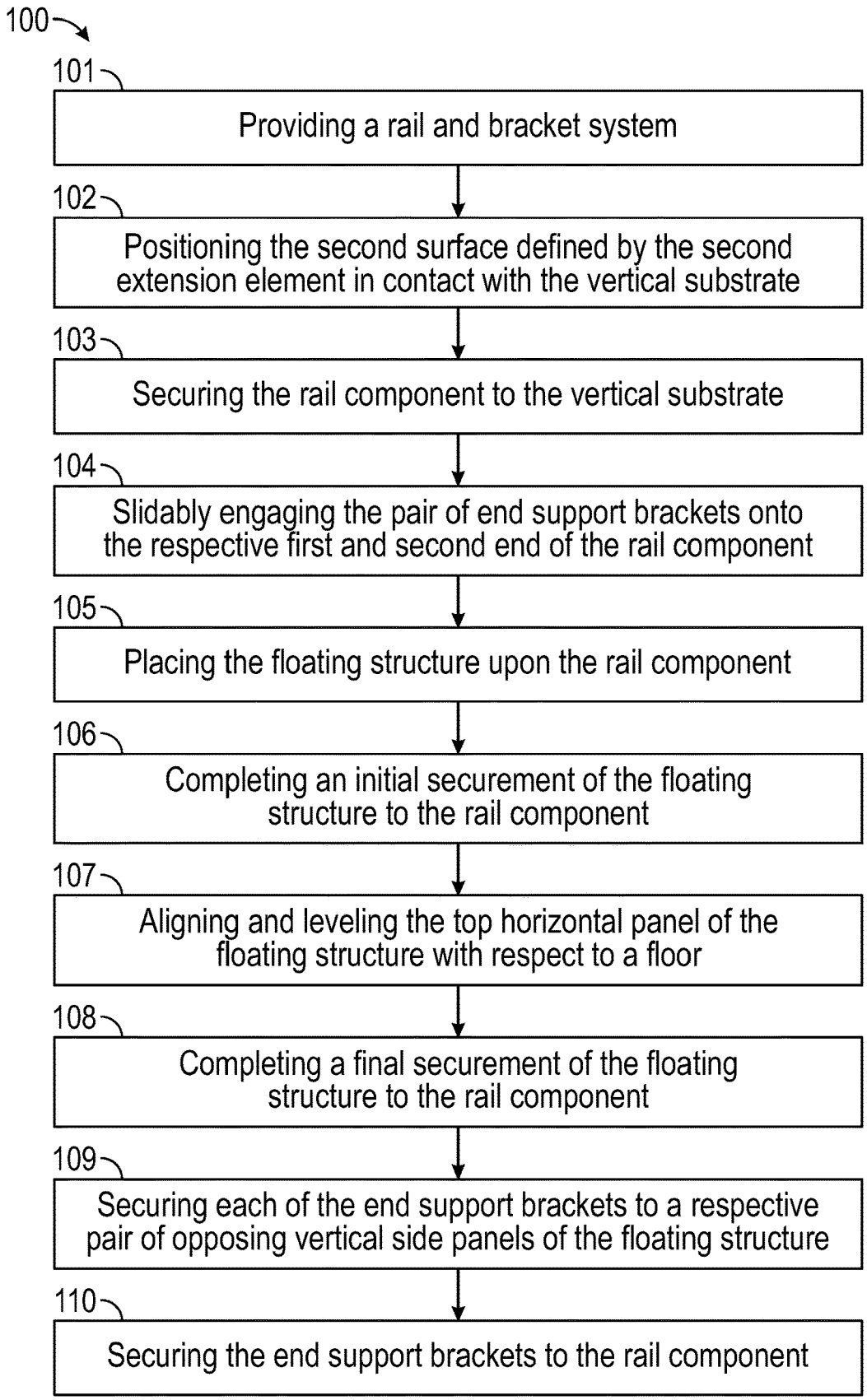
FIG. 11 is a flow diagram showing an illustrative method of mounting a floating structure, such as a cabinet, to a vertical substrate via the rail and bracket system of the present disclosure.

Referring to FIG. 11, at step 101, a rail and bracket system 10 is provided as described herein. More particularly, the rail and bracket system 10 is adapted to be mounted to a vertical substrate 12 and utilizes tandem weight distribution to support and secure a floating structure 14 to such vertical substrate 12. The rail and bracket system 10 comprises a rail component 16 having a first end 18 and a second end 20, wherein the second end 20 is disposed opposite the first end 18, a first extension element 22 that defines a first surface 23, and a second extension element 24 that defines a second surface 25. Furthermore, the rail and bracket system 10 comprises a pair of end support brackets 26*a*, 26*b*, each end support bracket 26*a*, 26*b* having a first flange 27*a*, a second flange 27*c*, and an intermediate portion 27*c* extending from the first flange 27*a* to the second flange 27*c*.

At step 102, the rail component 16 may be positioned or placed against the wall 12 at a desired height in a leveled position, such that the second surface 25 of the third portion 24*c* of the second extension element 24 is disposed in contact with the wall 12.

At step 103, the rail component 16 may be secured or attached to the vertical substrate or wall 12. More particularly, securing the rail component 16 to the vertical substrate 12 may further comprise inserting a plurality of attachment features 36 received through a corresponding plurality of apertures 34 (the first plurality of apertures) dispersed along a length of the rail component 16 from the first end 18 to the second end 20. In one example embodiment, the plurality of attachment features 36 are screws. At this step, it is contemplated that the location, placement, and number of attachment features 36 and corresponding apertures 34 utilized on the rail component 16 may vary depending on the overall length of the rail component 16. For example, longer rails may require more attachment features 36 and corresponding apertures 34 to be utilized at locations spaced closer in distance along the length of the rail component 16 to aid in the secure attachment of the rail component 16 to the wall 12.

Figure 10A:
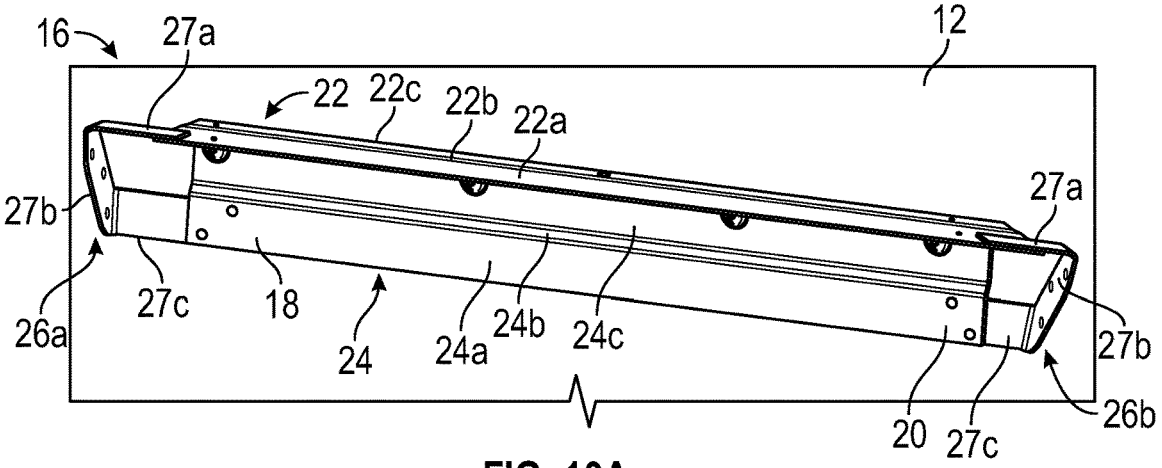
FIG. 10A is a perspective view of the rail and bracket system, and more particularly an illustrative rail adapted to receive a plurality of end support brackets.

As shown in FIG. 10A, once the rail component 16 is mounted and secured to the wall 12 at step 102, the end support brackets 26*a*, 26*b* are slidably engaged onto and along the first and second ends 18, 20 of the rail component 16 at step 104. In an assembled state, the first and second flanges 27*a*, 27*c* of the end support brackets 26*a*, 26*b* are positioned onto the rail component 16 at the first and second ends 18, 20. Specifically, at the first end 18 and second end 20 of the rail component 16, the first portion 22*a* of the first extension element 22 engages the first flange 27*a* of the end support brackets 26*a*, 26*b*. Similarly, the first portion 24*a* of the second extension element 24 engages the second flange 27*c* of the end support brackets 26*a*, 26*b*. Said another way, the intermediate portions 27*b* of the end support brackets 26*a*, 26*b* abut the rail component lateral sides of each of the first extension element 22 and the second extension element 24. The end support brackets 26*a*, 26*b* are initially held in place via a friction fit between the end support brackets 26*a*, 26*b* and the respective first portions 22*a*, 24*a* of the rail component 16.

Figure 10B:
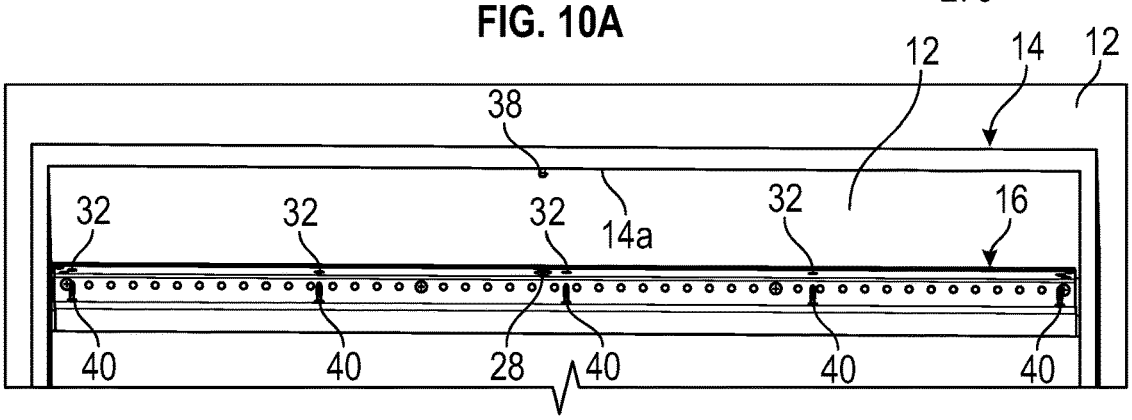
FIG. 10B is a partial schematic perspective view of the rail and bracket system, wherein the rail and bracket system is secured to a wall, the cabinet is engaged onto the rail component, and the top portion of the rail component is adapted for attachment to the top portion of the cabinet via additional fastening features, such as screws.

Next, at step 105, the floating structure or cabinet 14 is placed upon the rail component 16, such that the first surface 23 defined by the third portion 22*c* of the first extension element 22 is disposed in contact with an interior surface 15 of the top horizontal panel 14*a* of the cabinet 14. At step 106, an initial securement of the cabinet 14 to the rail component 16 is then completed by coupling the first extension element 22 of the rail component 16 and the top horizontal panel 14*a* of the cabinet 14. As shown in FIG. 10B, this initial securement is completed by inserting a security fastener 38 through a security mounting aperture 28 defined by the first extension element 22 of the rail component 16 and into the top horizontal panel 14*a* of the cabinet 14. In this way, the security mounting fastener 38 is fastened in a location corresponding to the security mounting aperture 28 of the rail component 16 to ensure proper alignment. The security mounting aperture 28 and corresponding fastener 38 allow for the initial securement of the cabinet 14 upon the rail component. Said another way, the insertion of the security fastener 38 through the security mounting aperture 28 initially helps to keep the cabinet 14 on the rail component 16 so the installer can align and level the cabinet 14 prior to the installation and securement of the end support brackets 26*a*, 26*b* to the cabinet 14. In one example embodiment, the security fastener 38 is fastened substantially at or near the midpoint of the interior surface 15 of the top horizontal panel 14*a* of the cabinet 14. In an example embodiment, the security fastener 38 is a screw. As such, at step 107, the top horizontal panel 14*a* of the cabinet 14 may then be aligned and leveled by an installer upon the rail component 16 with respect to a floor from front to back, so as to confirm proper and desired positioning or leveling of the cabinet 14.

As further shown in FIG. 10B, at step 108, once the cabinet 14 is positioned and aligned by the installer, fastening features 40 are received through the corresponding plurality of apertures 32 (the second plurality of apertures) for final securement of the interior surface 15 of the top horizontal panel 14*a* of the cabinet 14 to the rail component 16. In one example embodiment, the fastening features 40 are screws. At this step, it is contemplated that the location, placement, and number of fastening features 40 and corresponding apertures 32 utilized on the rail component 16 may vary depending on the overall length of the rail 16. For example, longer rails 16 may require more fastening features 40 and corresponding apertures 32 to be utilized at locations spaced closer in distance along the length of the rail 16 to aid in secure attachment of the rail component 16 to the floating structure 14.

Figure 10C:
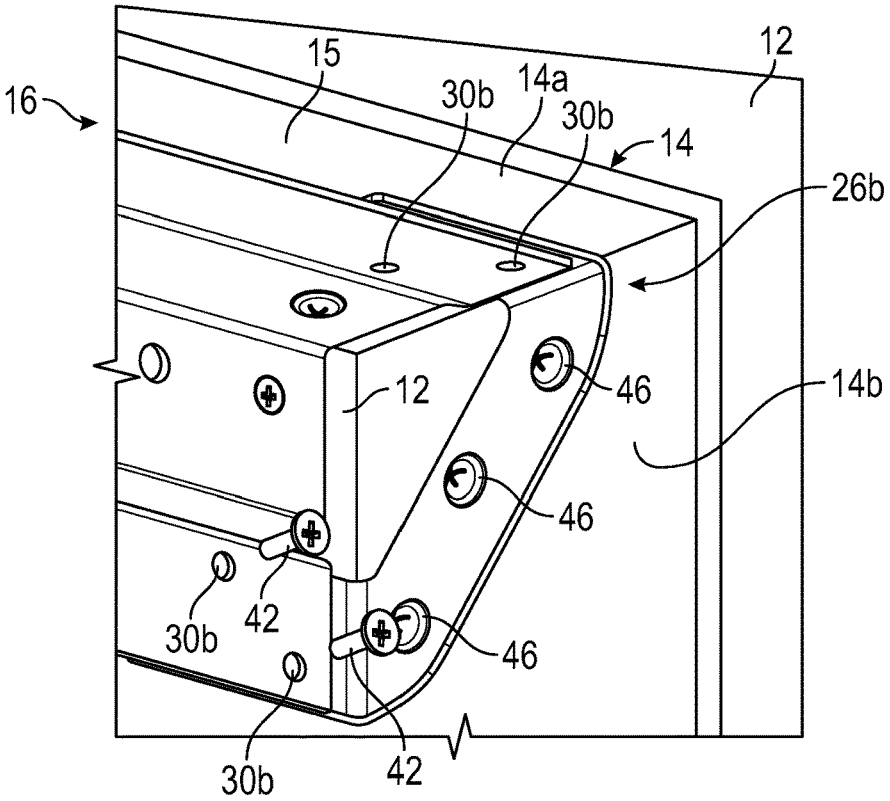
FIG. 10C is a partial schematic perspective view of the rail and bracket system, wherein the rail and bracket system is attached to a wall, and the top portion of the cabinet and the rear portion of the rail is adapted for attachment to the vertical substrate via securing features, such as screws.

Referring now to FIG. 10C, at step 109, the end support brackets 26*a*, 26*b* are first fastened or secured to the respective vertical panels 14*b* of the floating structure or cabinet 14 by a plurality securing features 46. The plurality of securing features 46 are received through the corresponding plurality of apertures 44 (the third plurality of apertures) of the end support brackets 26*a*, 26*b*. In one example embodiment, the plurality of securing features 46 are screws.

Next, at step 110, the end support brackets 26*a*, 26*b* are fastened or secured to the rail component 16 via a plurality of coupling features 42. The plurality of coupling features 42 are received through the corresponding apertures 30*a*, 30*b* (fourth plurality of apertures 30*a* and fifth plurality of apertures 30*b*), thereby fastening the rail component 16 to the end support brackets 26*a*, 26*b*. In one example embodiment, the plurality of coupling features 42 are self-tapping steel screws.

In the manner described above, the rail and bracket system 10 of the present teachings allows for efficient and effective alignment and installation of floating storage fixtures to a substantially vertical substrate, such as a wall. Furthermore, the rail and bracket system 10 of the present teachings utilizes tandem weight distribution to support and secure the floating structure to the vertical substrate i.e., the rail attaches to the interior surface of the top panel of the floating structure and the end support brackets attach to the respective vertical side panels of the floating structure.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

Benefits, other advantages, and solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

LISTING OF REFERENCE NUMERALS

10 Rail and Bracket System
12 Vertical Substrate
14 Cabinet/Floating Structure
14*a* Horizontal Panels (of Cabinet/Floating Structure 14)
14*b* Vertical Panels (of Cabinet/Floating Structure 14)
15 Interior Surface (of Cabinet/Floating Structure 14)
16 Rail Component
18 First End (of Rail Component 16)
20 Second End (of Rail Component 16)
22 First Extension Element (of Rail Component 16)
22*a* First Portion (of First Extension Element 22)
22*b* Second Portion (of First Extension Element 22)
22*c* Third Portion (of First Extension Element 22)
23 First Surface Defined by First Extension Element
24 Second Extension Element (of Rail Component 16)
24*a* First Portion (of Second Extension Element 24)
24*b* Second Portion (of Second Extension Element 24)
24*c* Third Portion (of Second Extension Element 24)
25 Second Surface Defined by the Second Extension Element
26*a* First End Support Bracket
26*b* Second End Support Bracket
27*a* First Flange (of End Support Bracket 26*a*, 26*b*)
27*b* Intermediate Portion (of End Support Bracket 26*a*, 26*b*)
27*c* Second Flange (of End Support Bracket 26*a*, 26*b*)
28 Security Mounting Aperture
30*a* Fourth Plurality of Apertures
30*b* Fifth Plurality of Apertures
32 Second Plurality of Apertures
34 First Plurality of Apertures
36 Attachment Features
38 Security Fastener
40 Fastening Features
42 Coupling Features
44 Third Plurality of Apertures
46 Securing Features

What is claimed is:

1. A rail and bracket system for mounting a floating structure to a vertical substrate comprising:

a rail component comprising:

a first end and a second end, wherein the second end is disposed opposite the first end; and a first extension element that defines a first surface and a second extension element that defines a second surface, wherein the first extension element and the second extension element further comprise a first portion, a second portion, and a third portion that extend from the first end to the second end of the rail component, and wherein the second portion of each of the first extension element and the second extension element is disposed between the first portion and the third portion thereof;

a pair of end support brackets configured to slidably engage with the rail component, such that a first end support bracket slidably engages with the first end of the rail component and a second end support bracket slidably engages with the second end of the rail component; and wherein the rail and bracket system is configured to be coupled to the vertical substrate, such that the second surface of the second extension element is disposed in contact with the vertical substrate and the first surface of the first extension element is disposed in contact with an interior of the floating structure.

2. The rail and bracket system of claim 1, wherein:

the first portion of the first extension element is radially spaced apart from and substantially parallel with the third portion of the first extension element, and wherein the second portion of the first extension element extends from the first portion of the first extension element to the third portion of the first extension element, such that the second portion is transverse to each of the first portion of the first extension element and the third portion of the first extension element; and the first portion of the second extension element is radially spaced apart from and substantially parallel with the third portion of the second extension element, and wherein the second portion of the second extension element extends from the first portion of the second extension element to the third portion of the second extension element, such that the second portion is transverse to each of the first portion of the second extension element and the third portion of the second extension element.

3. The rail and bracket system of claim 1, wherein the third portion of the first extension element defines a security mounting aperture configured to receive a security fastener, and wherein the security fastener couples the rail component at the securing mounting aperture to the interior of the floating structure.

4. The rail and bracket system of claim 3, wherein:

the third portion of the second extension element defines a first plurality of apertures disposed along a length of the rail component from the first end to the second end; and the first plurality of apertures is configured to receive a plurality of attachment features, such that the plurality of attachment features secures the rail component to the vertical substrate.

5. The rail and bracket system of claim 4, wherein the third portion of the first extension element defines a second plurality of apertures disposed between the first end and the second end of the rail component, wherein the second plurality of apertures is configured to receive a plurality of fastening features, such that the plurality of fastening features secures the floating structure to the rail component.

6. The rail and bracket system of claim 5, wherein each of the first end support bracket and the second end support bracket further comprise:

a first flange;

a second flange; and an intermediate portion that extends from the first flange to the second flange.

7. The rail and bracket system of claim 6, wherein each of the first end support bracket and the second end support bracket further define a third plurality of apertures spatially arranged along the intermediate portion thereof, and wherein each of the third plurality of apertures is configured to receive a securing feature, such that the respective securing features secure each of the first end support bracket and the second end support bracket to the interior of the floating structure.

8. The rail and bracket system of claim 7, wherein:

each of the first portion of the first extension element and the first portion of the second extension element define a fourth plurality of apertures disposed at the first end of the rail component, wherein each of the fourth plurality of apertures is configured to receive a coupling feature, such that the respective coupling feature operatively couples the first support bracket to the first end of the rail component; and each of the first portion of the first extension element and the first portion of the second extension element define a fifth plurality of apertures disposed at the second end of the rail component, wherein each of the fifth plurality of apertures is configured to receive a coupling feature, such that the respective coupling feature operatively couples the second support bracket to the second end of the rail component.

9. The rail and bracket system of claim 1, wherein the rail component is formed as a unitary piece.

10. The rail and bracket system of claim 1, wherein each of the rail component and the pair of end support brackets comprise a powder coated steel material.

11. The rail and bracket system of claim 1, wherein the vertical substrate is a wall, and wherein the floating structure is a cabinet.

12. A method of mounting a floating structure to a vertical substrate, the method comprising:

providing a rail and bracket system adapted to be mounted to the vertical substrate, the rail and bracket system comprising:

a rail component having a first end and a second end, wherein the second end is disposed opposite the first end, a first extension element that defines a first surface and a second extension element that defines a second surface, wherein the first extension element and the second extension element further comprise a first portion, a second portion, and a third portion that extend from the first end to the second end of the rail component, and wherein the second portion of each of the first extension element and the second extension element is disposed between the first portion and the third portion thereof; and a pair of end support brackets configured to slidably engage with the rail component, such that a first end support bracket slidably engages with the first end of the rail component and a second end support bracket slidably engages with the second end of the rail component, each end support bracket having a first flange, a second flange, and an intermediate portion extending from the first flange to the second flange;

positioning the second surface defined by the second extension element in contact with the vertical substrate, such that the rail component is disposed in a horizontally-leveled position on the vertical substrate;

securing the rail component to the vertical substrate;

slidably engaging the pair of end support brackets onto the respective first end and second end of the rail component;

placing the floating structure upon the rail component, such that the first surface of the first extension element is disposed in contact with an interior surface of a top horizontal panel of the floating structure;

completing and initial securement of the floating structure to the rail component by coupling the first extension element of the rail component and the top horizontal panel of the floating structure by inserting a security fastener through a security mounting aperture defined by the first extension element of the rail component and into the top horizontal panel of the floating structure;

aligning and leveling the top horizontal panel of the floating structure with respect to a floor;

completing a final securement of the floating structure to the rail component;

securing each of the end support brackets to a respective pair of opposing vertical side panels of the floating structure; and securing the end support brackets to the rail component.

13. The method of claim 12, wherein the step of securing the rail component to the vertical substrate further comprises inserting a plurality of attachment features through a first plurality of apertures defined by the second extension element and dispersed along a length of the rail component.

14. The method of claim 13, wherein the step of completing a final securement of the floating structure to the rail component further comprises inserting a plurality of fastening features through a second plurality of apertures defined by the first extension element of the rail component.

15. The method of claim 14, wherein the second plurality of apertures defined by the first extension element of the rail component are positioned at each of the first end and the second end of the first extension element of the rail component.

16. The method of claim 14, wherein the second plurality of apertures defined by the first extension element of the rail component are positioned along the length of the rail component.

17. The method of claim 14, wherein the step of securing each of the end support brackets to the respective pair of opposing vertical side panels of the floating structure further comprises inserting a plurality of securing features through a third plurality of apertures defined by the intermediate portion of the respective end support brackets.

18. The method of claim 17, wherein the step of securing the end support brackets to the rail component further comprises inserting a plurality of coupling features through a fourth plurality of apertures defined by the first extension element of the rail component and the first flange.

19. The method of claim 18, wherein the step of securing the end support brackets to the rail component further comprises inserting the plurality of coupling features through a fifth plurality of apertures defined by the second extension element of the rail component and the second flange.

* * * * *